US005284191A

United States Patent [19]

McGarvey

[11] Patent Number: 5,284,191

[45] Date of Patent: * Feb. 8, 1994

[54] SAFETY TANK APPARATUS FOR LIQUID STORAGE

[75] Inventor: David C. McGarvey, San Gabriel, Calif.

[73] Assignee: LRS, Inc., El Monte, Calif.

[ * ] Notice: The portion of the term of this patent subsequent to Feb. 5, 2008 has been disclaimed.

[21] Appl. No.: 862,211

[22] Filed: Apr. 2, 1992

Related U.S. Application Data

[63] Continuation-in-part of Ser. No. 681,003, Apr. 5, 1991, Pat. No. 5,137,064, which is a continuation-in-part of Ser. No. 562,820, Aug. 6, 1990, Pat. No. 5,005,615.

[51] Int. Cl.[5] ..... B65B 1/04; B67C 3/00

[52] U.S. Cl. ..... 141/198; 141/98; 141/86; 141/95; 141/206; 141/227; 220/444; 137/312; 137/429; 417/9; 417/41

[58] Field of Search ..... 141/97, 98, 95, 96, 141/86, 88, 192, 198, 206, 217, 220, 227, 228, 229; 220/444, 445, 453, 466, 467, 3.1, 18; 137/312, 376, 427, 429; 417/9, 41

[56] References Cited

U.S. PATENT DOCUMENTS

| | | |
|---|---|---|
| 810,237 | 1/1906 | Wadsworth . |
| 1,114,019 | 10/1914 | Morris . |
| 1,170,377 | 2/1916 | Weed . |
| 1,273,195 | 7/1918 | Synder . |
| 1,625,765 | 4/1927 | Ratzenstein . |
| 1,724,582 | 8/1929 | Hart . |
| 2,102,912 | 12/1937 | Pittman . |
| 2,460,054 | 1/1949 | Wiggins . |
| 2,558,694 | 6/1951 | Speig . |
| 2,623,362 | 12/1952 | Zerbe . |
| 2,772,834 | 12/1956 | Swenson et al. . |
| 2,835,270 | 5/1958 | York et al. . |
| 2,858,136 | 10/1958 | Rind . |
| 2,860,807 | 11/1958 | Morton . |
| 2,864,527 | 12/1958 | Altman et al. . |
| 2,869,751 | 1/1959 | Klope et al. . |
| 2,931,211 | 4/1960 | McCullough . |
| 3,595,424 | 7/1971 | Jackson . |
| 3,605,782 | 7/1969 | Hollis et al. . |
| 3,666,132 | 5/1972 | Yamamoto et al. . |
| 3,702,592 | 11/1972 | Gamble . |
| 3,732,902 | 5/1973 | Muller . |
| 3,827,455 | 8/1974 | Lee . |
| 3,941,272 | 3/1976 | McLaughlin . |
| 3,952,907 | 4/1976 | Ogden et al. . |
| 3,967,256 | 6/1976 | Galatis . |
| 3,969,563 | 7/1976 | Hollis, Sr. . |
| 4,161,957 | 7/1979 | Schoellkopf . |

(List continued on next page.)

FOREIGN PATENT DOCUMENTS

| | | |
|---|---|---|
| 01654 | 3/1990 | PCT Int'l Appl. . |
| 2209183 | 5/1989 | United Kingdom . |

OTHER PUBLICATIONS

Uniform Fire Code, 1985 Ed., pp. 203-278.

Reliance Tank Sales Materials (undated)-price list date Jan. 20, 1989.

Agape Tank Sales Materials (dated by postmark Jun. 7, 1989.

(List continued on next page.)

*Primary Examiner*—Ernest G. Cusick

*Attorney, Agent, or Firm*—William W. Haefliger

[57] ABSTRACT

A safety tank apparatus is provided for installation to receive and store a liquid hydrocarbon or hydrocarbons, or the like, and from which the liquid may be withdrawn. It comprises tank structure including an inner metallic tank; an outer metallic tank protectively receiving the inner tank with accessible interior space laterally of the inner tank; a barrier wall between that interior space and the inner wall: an opening in the outer tank sidewall adjacent that interior space; and a closure closing the opening, the closure movable to expose the interior space to access from the exterior; and tank liquid flow control structure accessible through the side wall opening, for controlling filling of the liquid into the inner tank from the exterior of the safety apparatus, and for controlling liquid removal from the inner tank.

34 Claims, 15 Drawing Sheets

U.S. PATENT DOCUMENTS

| | | | |
|---|---|---|---|
| 4,281,692 | 8/1981 | Caccamisi . | |
| 4,376,489 | 3/1983 | Clemens . | |
| 4,478,345 | 10/1984 | Edinger . | |
| 4,651,893 | 3/1987 | Mooney . | |
| 4,685,327 | 8/1987 | Sharp . | |
| 4,697,618 | 10/1987 | Youtt et al. . | |
| 4,815,621 | 3/1989 | Bartis . | |
| 4,826,644 | 5/1989 | Lindquist et al. . | |
| 4,844,287 | 7/1989 | Long . | |
| 4,890,983 | 1/1990 | Solomon et al. . | |
| 4,911,326 | 3/1990 | McGouran, Jr. . | |
| 4,934,553 | 6/1990 | McCarthy . | |
| 4,948,010 | 8/1990 | Wiggins . | |
| 4,989,750 | 2/1991 | McGarvey . | |
| 5,005,615 | 4/1991 | McGarvey et al. . | |
| 5,012,949 | 5/1991 | McGarvey et al. . | |
| 5,016,689 | 5/1991 | McGarvey et al. . | |
| 5,088,530 | 2/1992 | Harp | 141/86 |
| 5,137,064 | 8/1992 | McGarvey | 141/198 |

OTHER PUBLICATIONS

Doehrman, Inc.-facsimile dated May 9, 1989.

Safe-T-Tank Corp. sales materials dated 1987-Sales materials from Air Boy (Jun. 1988)-advertisement dated Feb. 1987 from Keesee, "Lube Cube" sales materials dated Jul. 1, 1988.

UL 142 Standard for Safety, Steel Aboveground Tanks (1987).

Husky 1030 Double Diaphragm Pump (1987) instructions and parts list.

"Oil Evacuation System" Aro Corp., (1982).

"½ Waste Oil Evacuation System" (drawing dated Mar. 15, 1987).

"Aro Air Operated Diaphragm Pumps" (1986).

"Aro Lubrication Equipment" (1989), pp. 31 and 33.

Cla-Val Co. Float control parts list (1977).

"Underwriters Laboratory Listed Tank", Air Boy Sales and Manufacturing Company.

27
30
23
3
24
52
48
40
53
31
54a
58
49
26
71
45
45
46
44
22e
47
22
66
60c
64
10
11
12
60
3
43
70a
42b'
20
21
19
42c
35
36
14
15
14
17
16
18
17

304
320c'
325
320c
326
40
45
42b'
~311b~
~311a~
380
316
316
312

304
320c'
325
320c
324
320a
312

SAFETY TANK APPARATUS FOR LIQUID STORAGE

This application is a continuation-in-part of Ser. No. 681,003 filed Apr. 5, 1991, now U.S. Pat. No. 5,137,064 which is a continuation of Ser. No. 562,820 filed Aug. 6, 1990, now U.S. Pat. No. 5,005,615, issued Apr. 9, 1991.

BACKGROUND OF THE INVENTION

This invention relates generally to containment or storage of waste oil and other fluids, particularly hydrocarbons, and/or flammable or dangerous liquids; and more particularly, to a simple, efficient, easily shipped, and operable containment system, wherein critical components are protected, yet easily accessed and operated.

There is great and continuing need for environmentally safe, easily shipped, and readily installable and usable containment systems for waste oil (for example engine crankcase oil) as well as other liquids and contaminants. Such systems should also be fireproof insofar as possible. I am not aware of any presently available system meeting this need, or having the usual advantages in construction, modes of operation and results, as afforded by the present invention.

SUMMARY OF THE INVENTION

It is a major object of the invention to provide an improved system meeting the above need, as well as providing additional advantages in construction and mode of operation. Basically, the safety tank or system of the invention comprises:

a) tank structure including an inner metallic tank, and an outer metallic tank protectively receiving the inner tank, the tank structure having a side wall, there being interior space laterally of the inner tank and within the tank structure, b) the tank structure including a barrier wall means extending between the inner tank and the interior space, c) an opening in the sidewall, and a locking closure closing the opening, the closure movable to expose the interior space to access from the exterior, d) and control means in the interior space, and accessible through the opening for controlling flow of the liquid into the inner tank from the exterior of the safety apparatus.

As will appear, the inner tank is enclosed; and when the side wall closure is closed, weather is excluded from interior space laterally of, and/or above the inner tank, so that the control means is protected, as well as space between the side walls of the inner and outer tanks, and space below the inner tank. That space may be vented. Enhanced fire protection is also thereby provided, the outer tank also offering protection, as from contaminant liquid leakage to the exterior of the inner tank. Such leakage might, for example, occur due to inadvertent handling of the hose or line connection to a liquid pump, or handling of other closures for bungs in the top cover of the inner tank.

It is a further object of the invention to provide for access to pump means having a liquid intake port and a delivery port, the delivery port communicating with the interior of the inner tank, and a pneumatic fluid control valve connected with the pump drive for controlling pressurized drive fluid flow to the pump drive. The valve has associated means for sensing the level of liquid in the inner tank, and for closing the valve in response to rising of the liquid surface to a predetermined level. Also, an audible alarm may the be activated. In this regard, the closed inner tank typically has an upper or top wall that supports the pump and valve to be directly accessible via the opening in the closure side wall.

Another object includes provision of means to control in-flow of liquid into the inner tank in response to liquid level changes in the inner tank and also within a safety space surrounding the inner tank.

Additional objects include the provision of a first aperture in the inner tank upper wall, via which liquid in the tank may be removed by a duct extending below the inner tank top wall; the provision of a second aperture in the inner tank top wall for venting air from the inner tank as liquid is filled into the inner tank by operation of the pump. These elements, as well as others, are easily accessed when the closure or door in the side wall of the tank structure is opened. Multiple tank combinations may also be provided.

These and other objects and advantages of the invention, as well as the details of an illustrative embodiment, will be more fully understood from the following specification and drawings, in which:

DRAWING DESCRIPTION

Figure 1:
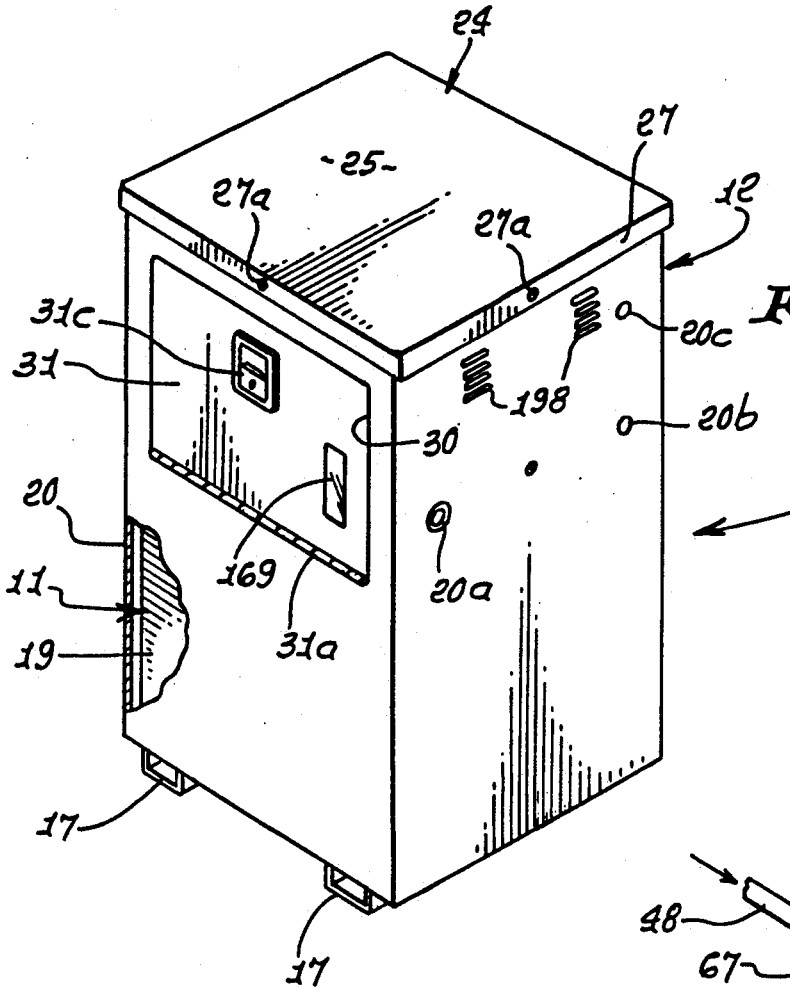
FIG. 1 is a perspective view showing a system in accordance with the invention.
Figure 21:
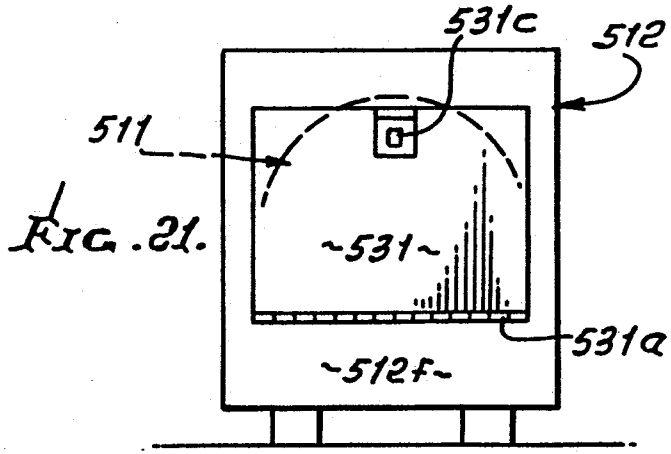
Figure 20:
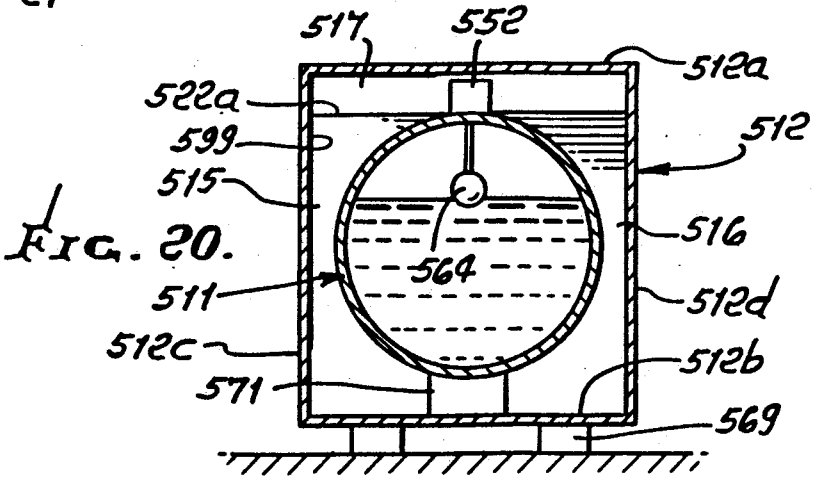
Figure 22:
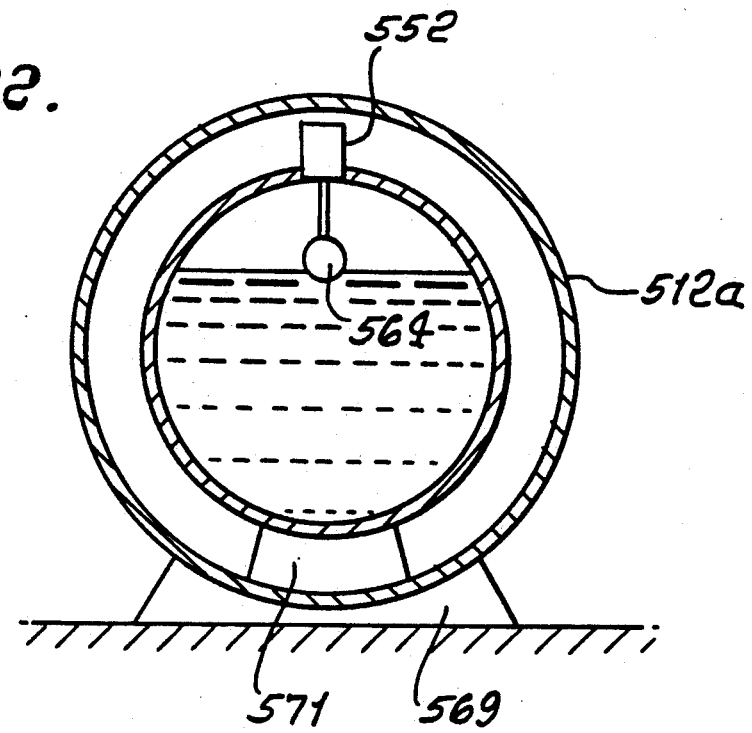
Figure 23:
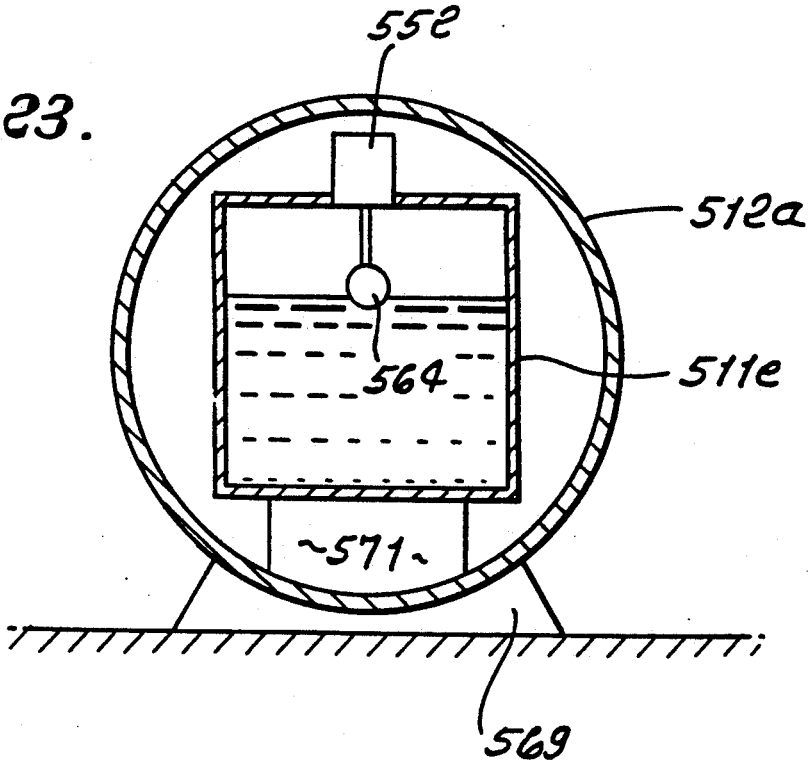
Figure 24:
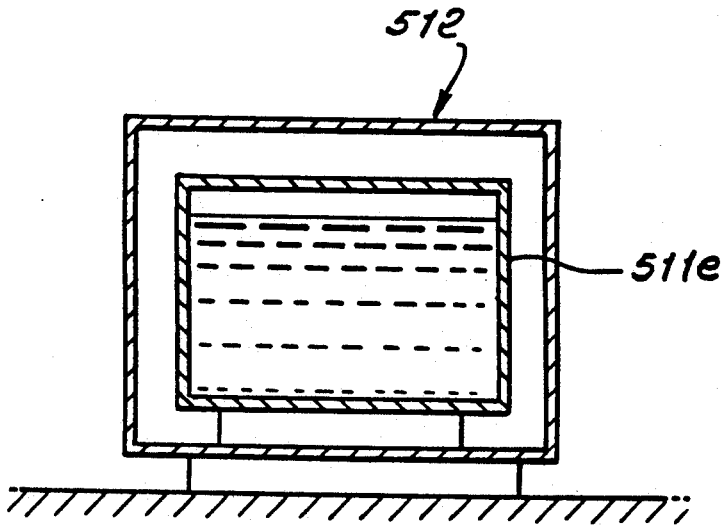
Figure 25:
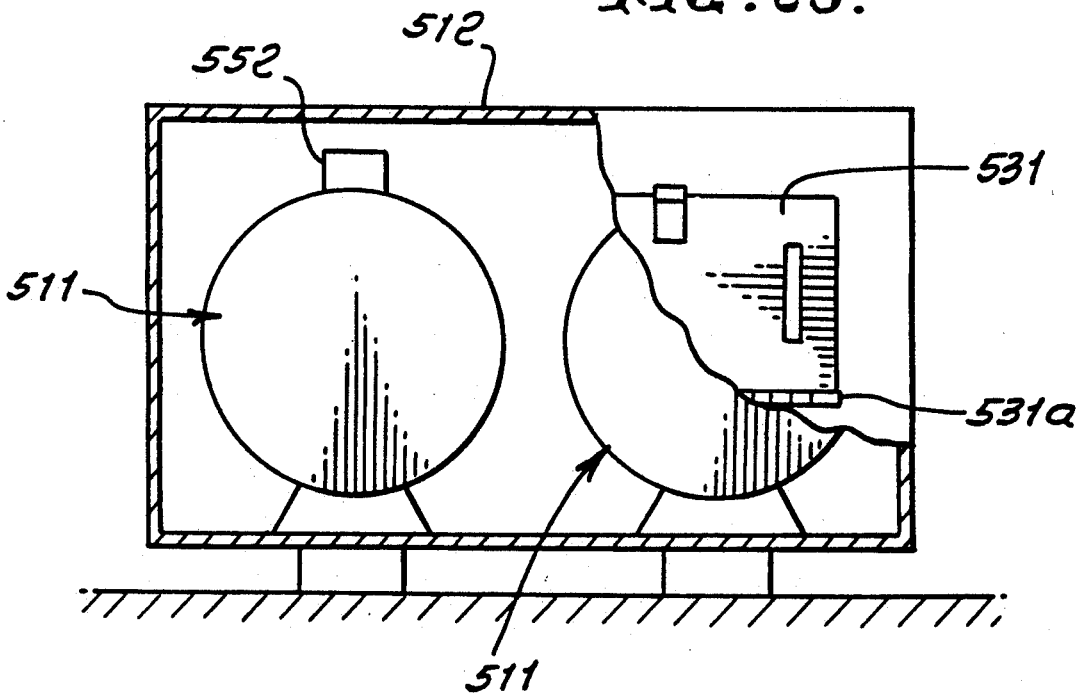

FIGS. 20 and 21 are views taken on lines 20—20 and 21—21, respectively, of FIG. 1;

FIGS. 22-24 are end views showing further modifications;

FIG. 25 is a view showing multiple inner tanks, within one outer tank; and

Figure 19:
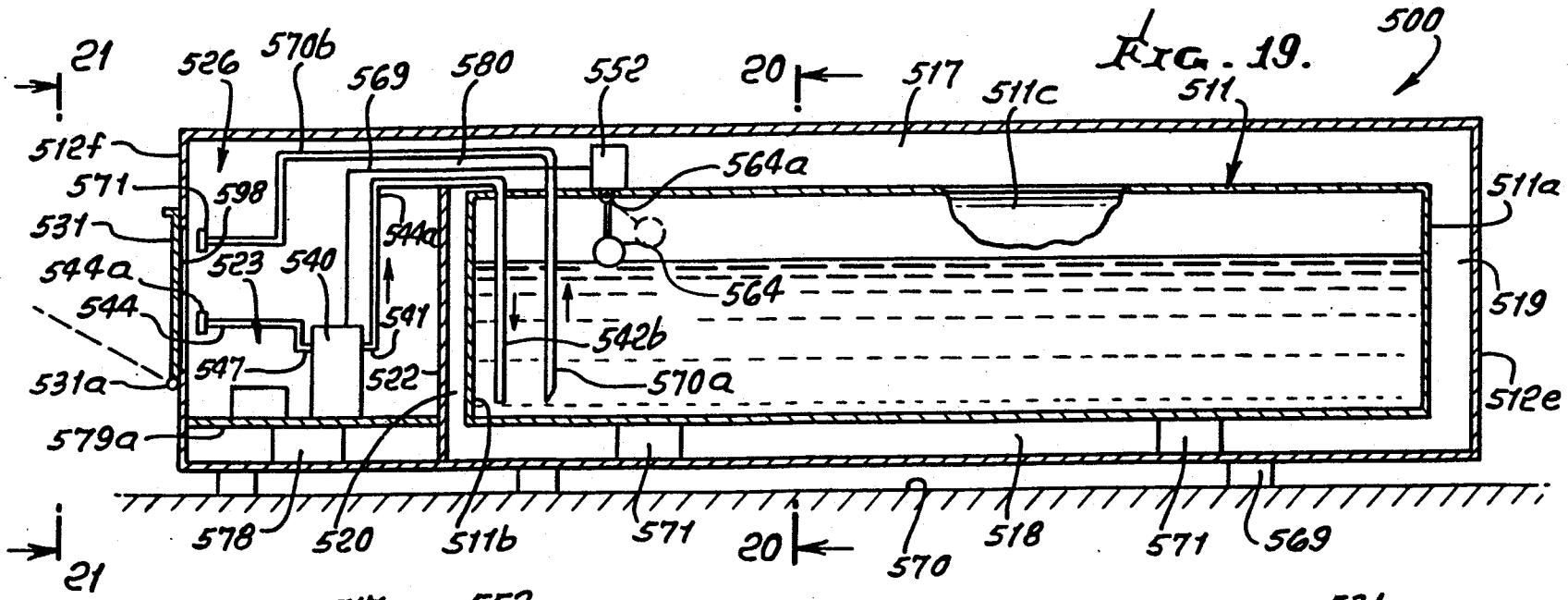
FIG. 19 is a view like FIG. 2 showing a modification.
Figure 26:
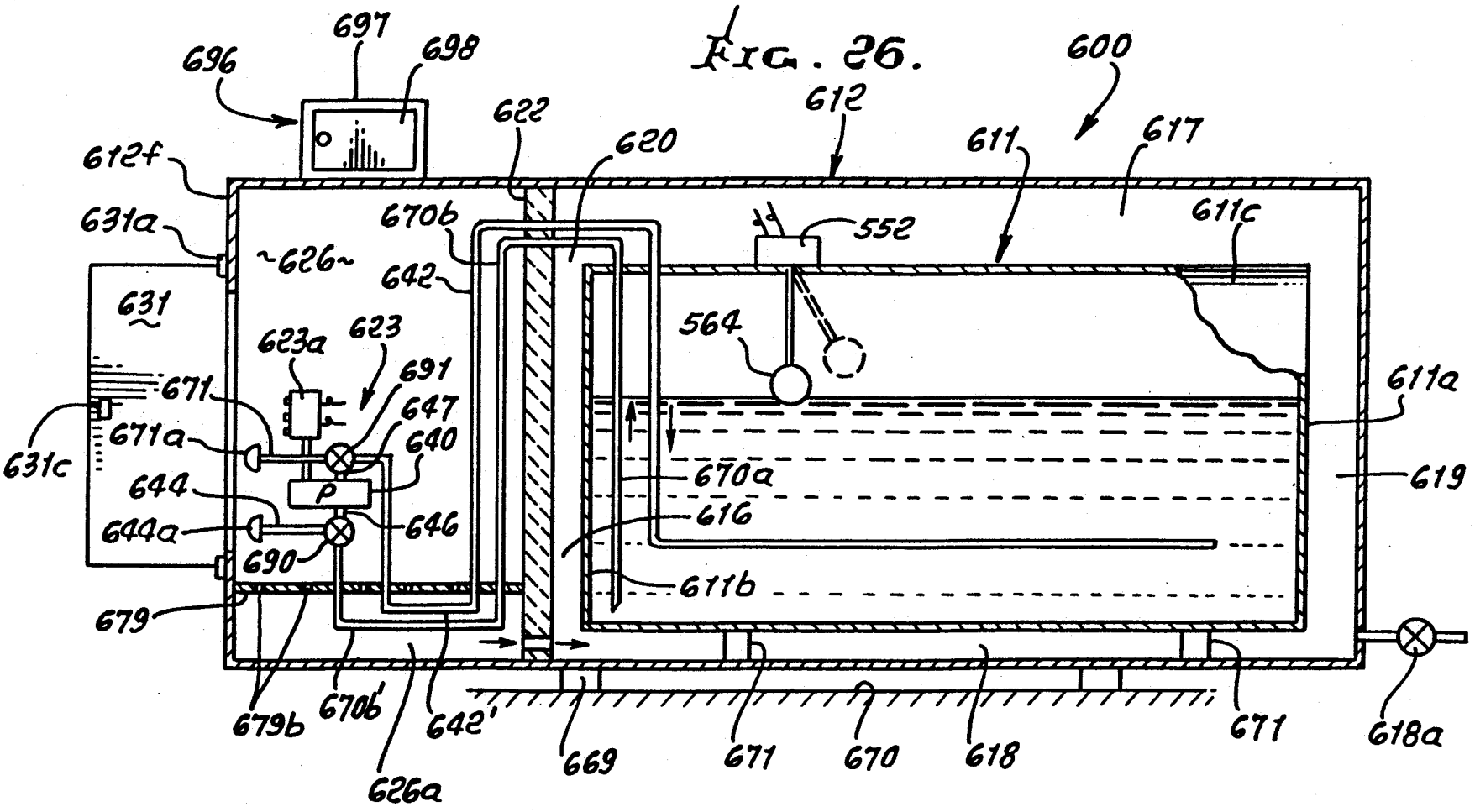

FIG. 26 is a view like FIG. 19 showing a further modification.

DETAILED DESCRIPTION

Figure 2:
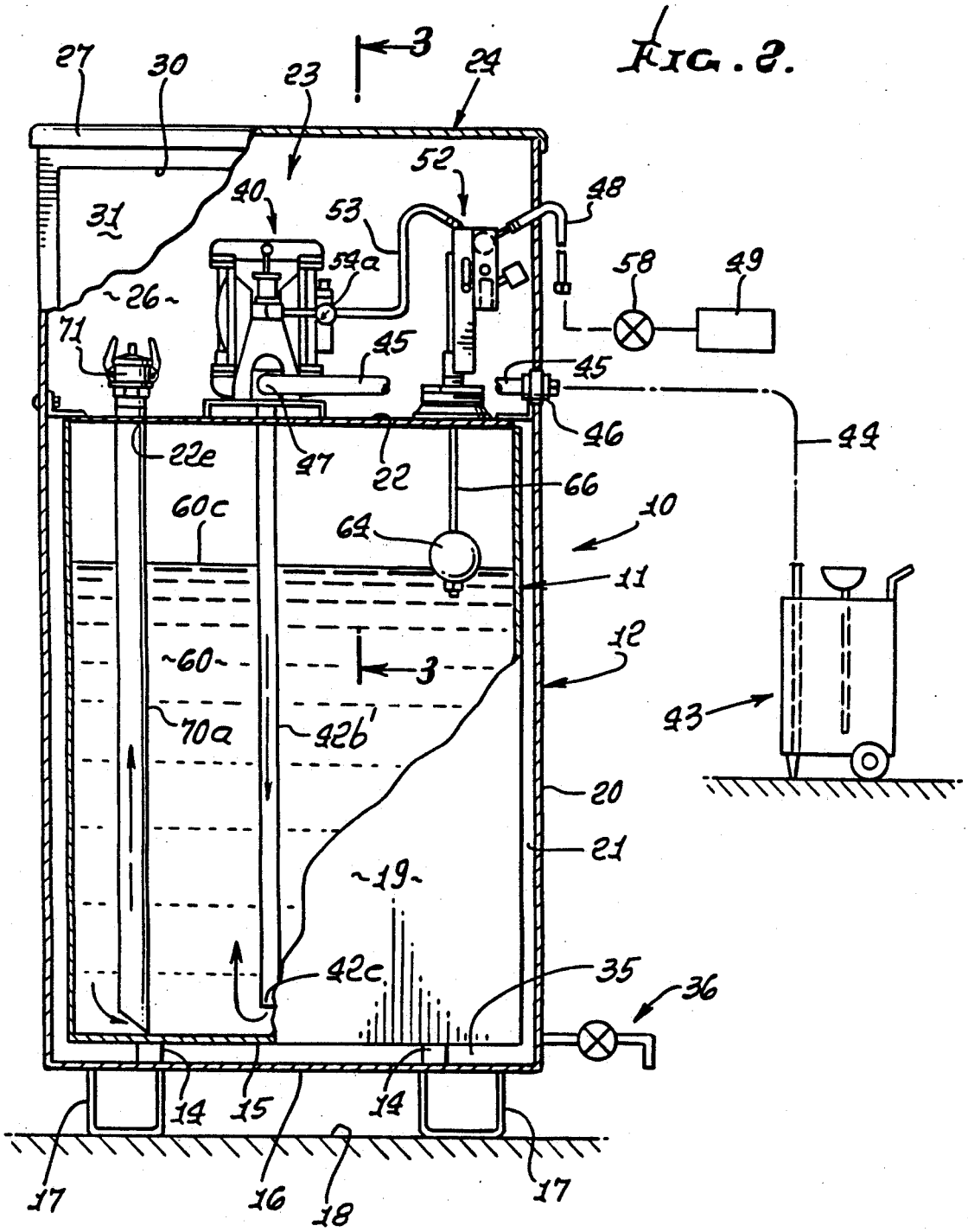
FIG. 2 is a section taken in elevation through the system of FIG. 1 to show interior construction.
Figure 3:
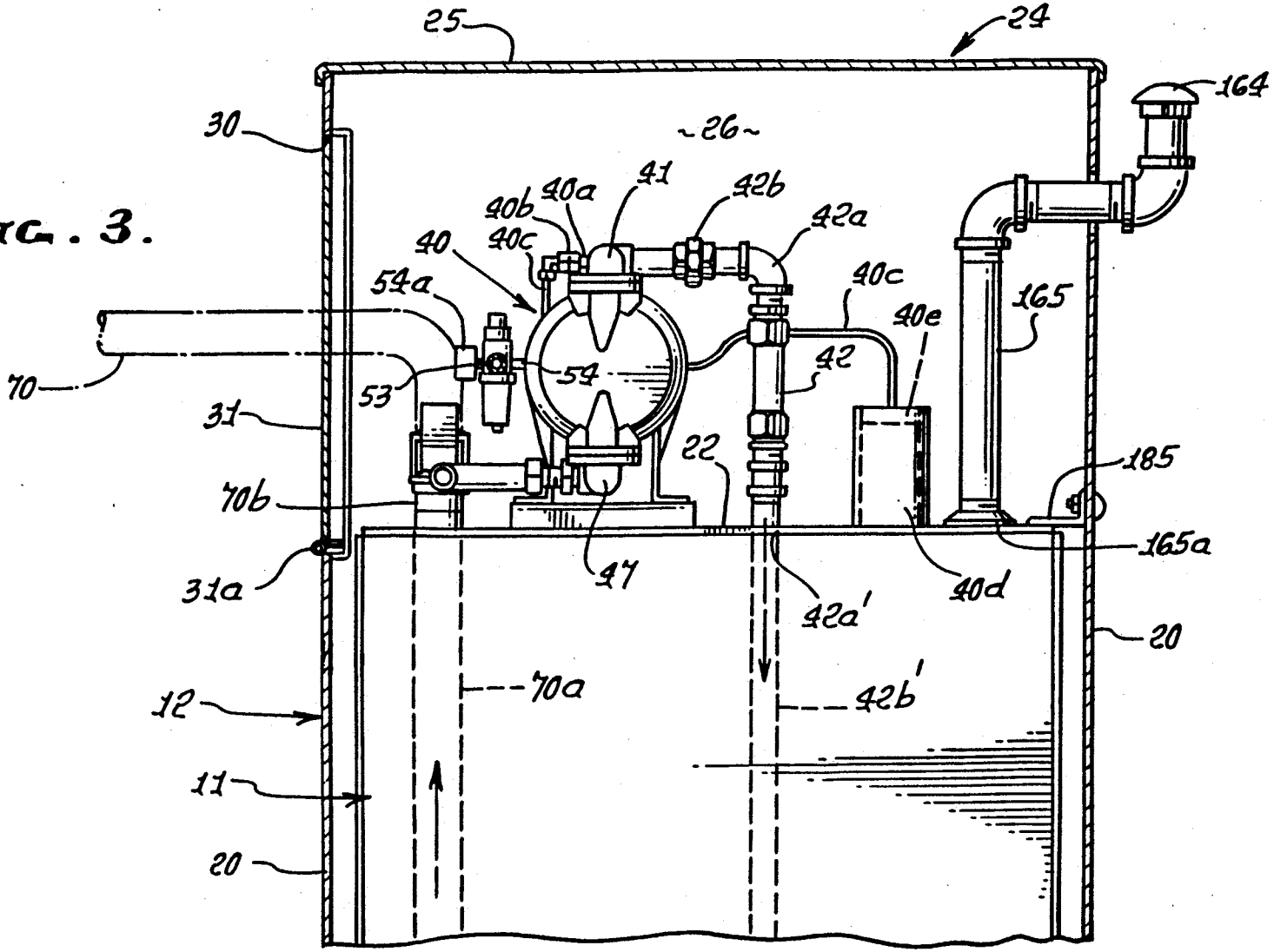
FIG. 3 is an enlarged section taken in elevation on lines 3—3 of FIG. 2.

In FIGS. 1-3, the safety tank apparatus 10 includes an inner metallic tank 11, which is closed, and an outer metallic tank 12 protectively receiving the inner tank. The outer tank is upwardly open and has a removable top or cover 24 so that the inner tank may be lowered downwardly into the inner tank to be supported by spaces 14 located between the bottom wall 15 of tank 11 and the bottom wall 16 of tank 12. Likewise, feet or spacers 17 support the bottom wall 16 on the ground or pavement 18. Feet 17 are channel-shaped to receive the tines of lift trucks or the like. Also, the feet allow visual inspection of the bottom of the outer tank and attachment to pavement 18.

The inner tank has a side wall or walls 19 which extend upright in inwardly closely spaced relation from the side wall or walls 20 of the outer tank. While various tank configurations are possible, each tank preferably has four walls, whereby inner tank 11 has maximum capacity. See space 21. All tank walls are typically metallic (thin steel sheet, for example) and walls 19 and 20 extend upright. The inner tank is closed by a metallic top wall 22, generally near but below the level of lower hinge 31*a* of a closure 31 for a side opening 30 in an upright wall of the outer tank, for lateral accessibility of controls mounted on that top wall 22, as will appear. Such controls are generally designated at 23. Note brackets 185 connecting walls 20 to top wall 22 to position the inner tank in the outer tank.

Cover 24 extends over the inner and outer tanks 10 and 11 to protect the controls 23 and secondary containment spaces 21 and 35. That cover 24 has a top wall 25 spaced above inner tank top wall 22 (see space or interior 26), and side wall or walls indicated at 27. The latter are removably attached to the outer tank side walls, as at 27*a*, rigidizing the overall assembly. Cover 24 may be square in outline, as shown.

As referred to, the closure 31 (lockable at 31*c*) is hinge attached to the outer tank front wall to be movable, i.e., openable for example on hinge or hinges 31*a*, to expose the space or interior 26 of the cover, thereby providing direct access to the controls, without having to lift or raise the top cover 24. Also, opening of the closure allows downward visual inspection of spaces 21 and 35. At the same time, the cover always provides protection for the controls, as against adverse weather, vandalism, impacts, etc. Also, with the closure 31 normally closed, outside air (i.e., oxygen) is sufficiently excluded from access to the interior 26, for minimizing risk of fire at the controls, and to exclude access of exterior flames to the controls and to the inner tank. Some air circulation is provided by louvered vents at 198.

The controls or control means 23 are so located, due to the construction and interfitting of the tanks 11 and 12 and the cover 24, as to provide direct lateral access to the controls via the opening 30, when the closure 31 is open. As shown, the controls are carried on the top wall 22 of the inner tanks so that any liquid spillage will drain downwardly into the narrow space between the tanks 11 and 12, to the bottom spaces 21 and 35. Liquid leaking to or otherwise collecting in spaces 21 or 35 may be removed as by a suction line.

Figure 4:
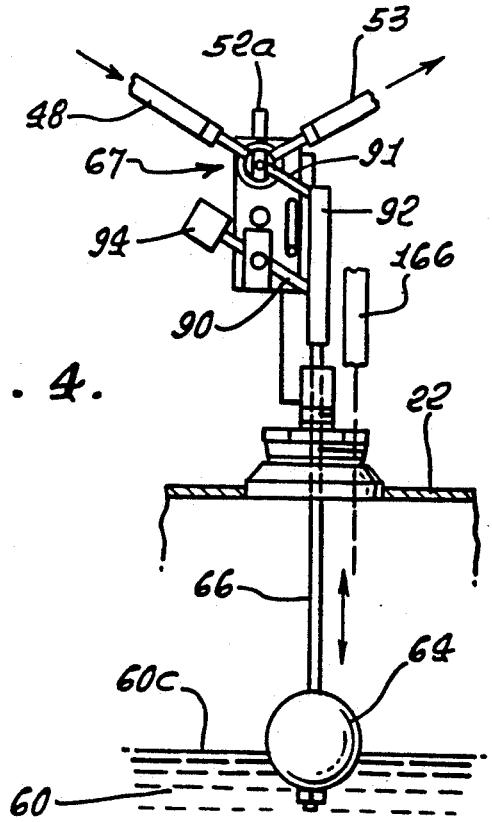
FIG. 4 is a schematic view of an air (pneumatic fluid) valve control mechanism.

Referring to FIGS. 3 and 4, the control means is shown to include a pump and pump motor unit 40, the pump having an intake port 47 for in-flowing waste liquid, and a discharge port 41 for that liquid. Unit 40 may be of double diaphragm, reciprocating type. Port 41 is connected via permanent line 42 and fitting 42*a* and 42*b* with a pipe or duct 42*b* extending vertically from a port 42*a* in top wall 22 downwardly to a discharge point 42*c* near bottom wall 15, whereby waste liquid pumped into the tank system is delivered into the inner tank. See also line or duct 44 extending from a waste liquid collection unit or caddy 43 (as used at oil change stations) to the pump intake line 45 in space 26. Line 45 extends from a connection at 46 to wall 20 via knockout 20*a* to the pump intake port 47. Duct 44 may be attached endwise to line 45 at the connection 46.

Likewise, a line 48 from a source 49 of pressurized air passes through upright wall 20 via knockout 20*b* and leads to a valve 52 near the pump. The valve is in turn connected at hose 53 to the pump motor air intake regulator 54*a*, which is in turn connected to pump motor air intake port 54. Thus, the pump may be air motor driven, for safety. Exhaust air is vented to space 26. An air supply control valve appears at 58 to control operation of the motor. Overflow liquid from the pump passes via port 40*a*, fitting 40*b*, and through line 40*c* and through a cap 40*e* of emergency relief vent 40*d* to drain into the inner tank. If excess pressure builds up in the inner tank, it is released by blow off of cap 40*e*.

Valve control means is provided for sensing the level of liquid in the inner tank, and for automatically closing the valve 52 in response to rising of the top level 60*c* of waste liquid 60 in the inner tank to a predetermined level, as for example to about 95% of full level in the inner tank. Also, the valve by-passes incoming air to a relief port 52*a* providing an audible alarm to indicate that level 60*c* has reached the predetermined level. Such control means is shown in FIG. 4 to include a float 64 in the inner tank, and floating in or on the waste liquid. A stem 66 connects the float to a rotating disc-type stopper at location 67 in the valve, to seat or close the stopper when 95% level is reached, thereby shutting off compressed air supply to the pump motor. Note parallelogram linkage arms 90 and 91 slidably connected with vertical link 92, attached to stem 66. Also note counterweight 94.

Liquid may be removed from the filled tank by unlocking and opening the access door 31, and by connecting a removal line 70 to a stand-pipe 70*a* in tank 11, and via a top opening 22*e* in wall 22, and a connection at 70*b*, pipe 70*a* normally closed by a cap 71 in space 26. Line 70 may be extended through the opening 30 in the outer tank side wall 20 when the closure 31 is opened. See FIG. 3. Other openings, with appropriate plugs, may be provided in top wall 22, as for example normal and emergency vents, to vent air and fumes from the upper tank as it is filled with liquid, etc. See vent pipe 165 and opening 165*a* to the inner tank. Pipe 165 passes through the opening provided by knockout 20*c*.

As noted, the system does not require any electricity, all components being mechanical.

Site level gauge 166 may be located next to the air shut-off valve, to indicate the remaining fill capacity of the inner storage tank. It is viewed via port or window 169 in closure 31. Port 169 has a covering of clear material, such as plexiglass, to provide for visual inspection of level gauge 166 without opening closure 31, and to keep weather and excess air out of spaces 21, 35 and 26.

When transferring liquid to the storage tank, the operator first looks at the site gauge to determine the existing fill capacity of the tank to see if transfer is possible, or if pick-up is needed. Second, the suction hose 44 is coupled to the collection caddy 43 and the air source is turned on, as by opening valve 58. When the collection caddy is emptied, the hose 44 is disconnected, and then the air is turned off at valve 58.

If the automatic shut-off valve 52 closes during transfer of liquids into the storage tank 11, the predetermined maximum fill level has been reached. The valve 52 will by-pass air from 40 to an audible air alarm 52*a* which can be located inside the enclosure or remotely The pump motor will then remain inoperable until the liquid in the tank has been lowered below the maximum fill level.

If at any time the site gauge 166 indicates the liquid level is near maximum fill capacity, or the automatic shut-off valve engages, the operator should contact a waste oil hauler to schedule a pick up.

When emptying the inner storage tank, the first step is to unlock the environmental closure 31 (normally locked at 31*c*) and open it so that the control assembly area is accessible. Second, a visual inspection of spaces 21, 35, and 26 should be conducted. Third, suction hose 70 from the truck should be connected to the coupler at bung 71 after removing the cap on the coupler. Fourth, when disconnecting the suction hose, the suction should remain "on" so the liquid remaining in the hose empties completely into the removal truck. Fifth, place the cap back on at 71, and conduct another visual inspection of spaces 21, 35 and 26. Sixth, the environmental closure 31 should be closed (or lifted) back into place and locked.

Space 26 is vented at openings 198 in side wall 20.

Drainage of inadvertently spilled liquid in space 26 can occur off top wall 22 into spaces 21 and 35, as referred to, for safety.

Figure 5:
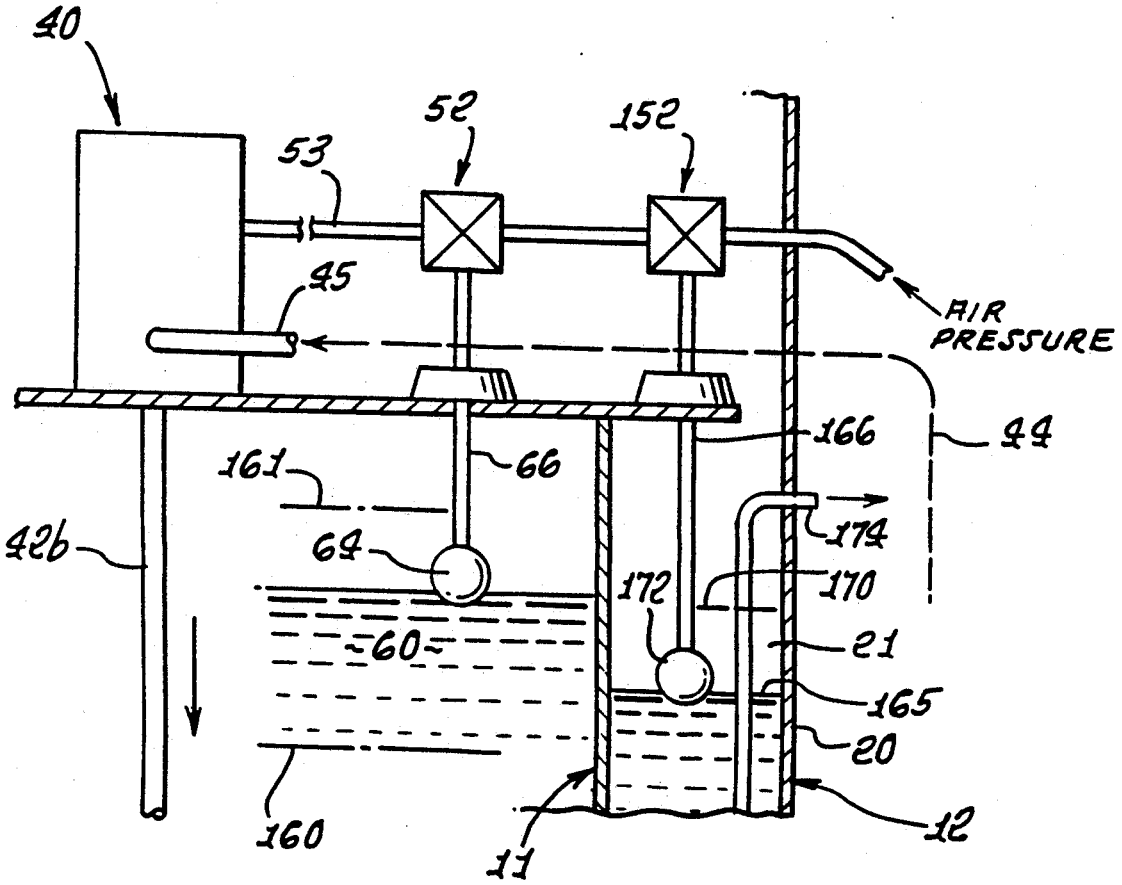
FIG. 5 is a schematic showing of automatic means to control in-flow of liquid to the inner tank.

In FIG. 5, elements the same as in FIGS. 2 and 4 bear the same numerals. Control means is provided for automatically effecting flow of liquid (hydrocarbon, for example) as via line 45 and pump 40, into the inner tank, from the exterior of the safety apparatus if the level of liquid in the inner tank drops below a predetermined level (see level 160); the control means also prevents flow of each liquid into the inner tank if the level of liquid rises to or above a predetermined upper level (see level 161). Such control means includes, for example, a valve 52 via which pressurized motive fluid (air, for example) flows via line 53 to the pump 40 operating to pump liquid via lines 45 and 42*b* into the inner tank, and a first float 64 for sensing the actual surface level of the liquid 60 in the inner tank. If the liquid level rises to 161, the float is elevated to a position to close valve 52, and if the level drops to 160, the float is lowered to a position to open valve 52. Other equivalent means may be employed.

Also provided is other control means for automatically preventing in-flow of liquid into the inner tank if the level 165 of liquid in space 21 is above a predetermined level, as at 170. This provides an additional safety feature in that, if the inner tank leaks to space 21, and sufficient liquid flows into that space, no further liquid will be passed into the inner tank. Note for example that such other control means may include a valve 152, like valve 52, and in series therewith via motive air pressure line 153. If the level of leaked fluid in space 21 rises to 170, the float 172 in space 21 also rises, causing a link 166 to close the valve 152, stopping the pump 40. Liquid in space 21 may then be sucked or pumped out, as at 174; and the float 172 then drops to open valve 152 and allow resumption of operation of pump. Equivalent structure may be provided.

Accordingly, in the example shown, the pump is controlled by automatic operation of either of the valves 52 or 152 by means of sensors sensing liquid levels in inner tank, and in the safety space 21 surrounding the inner tank.

Figure 7:
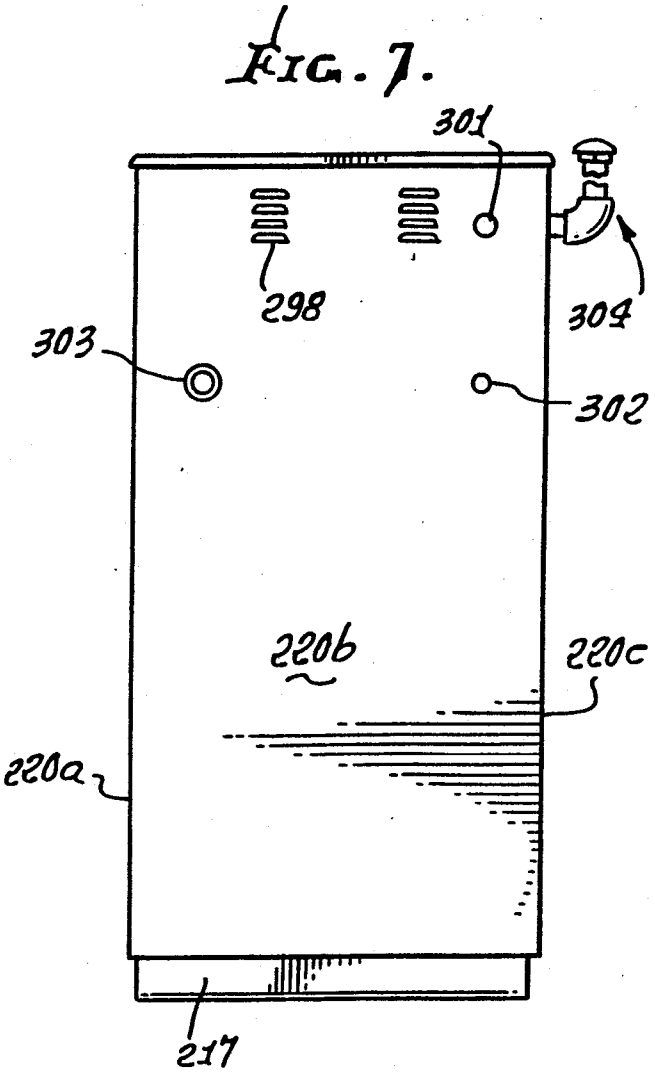
FIG. 7 is an end elevation taken on lines 7—7 of FIG. 6.
Figure 6:
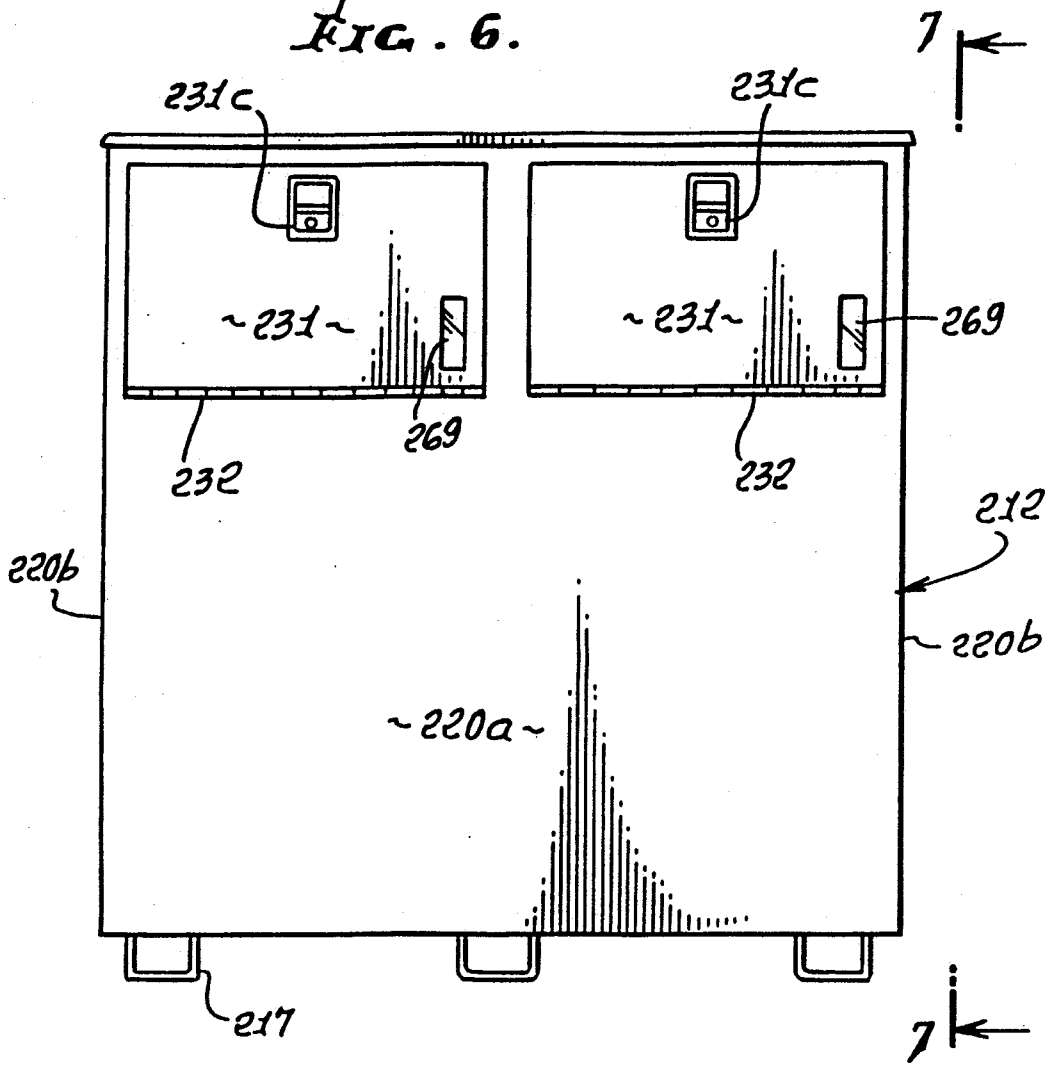
FIG. 6 is a front elevation of a modified multi-tank unit.
Figure 8:
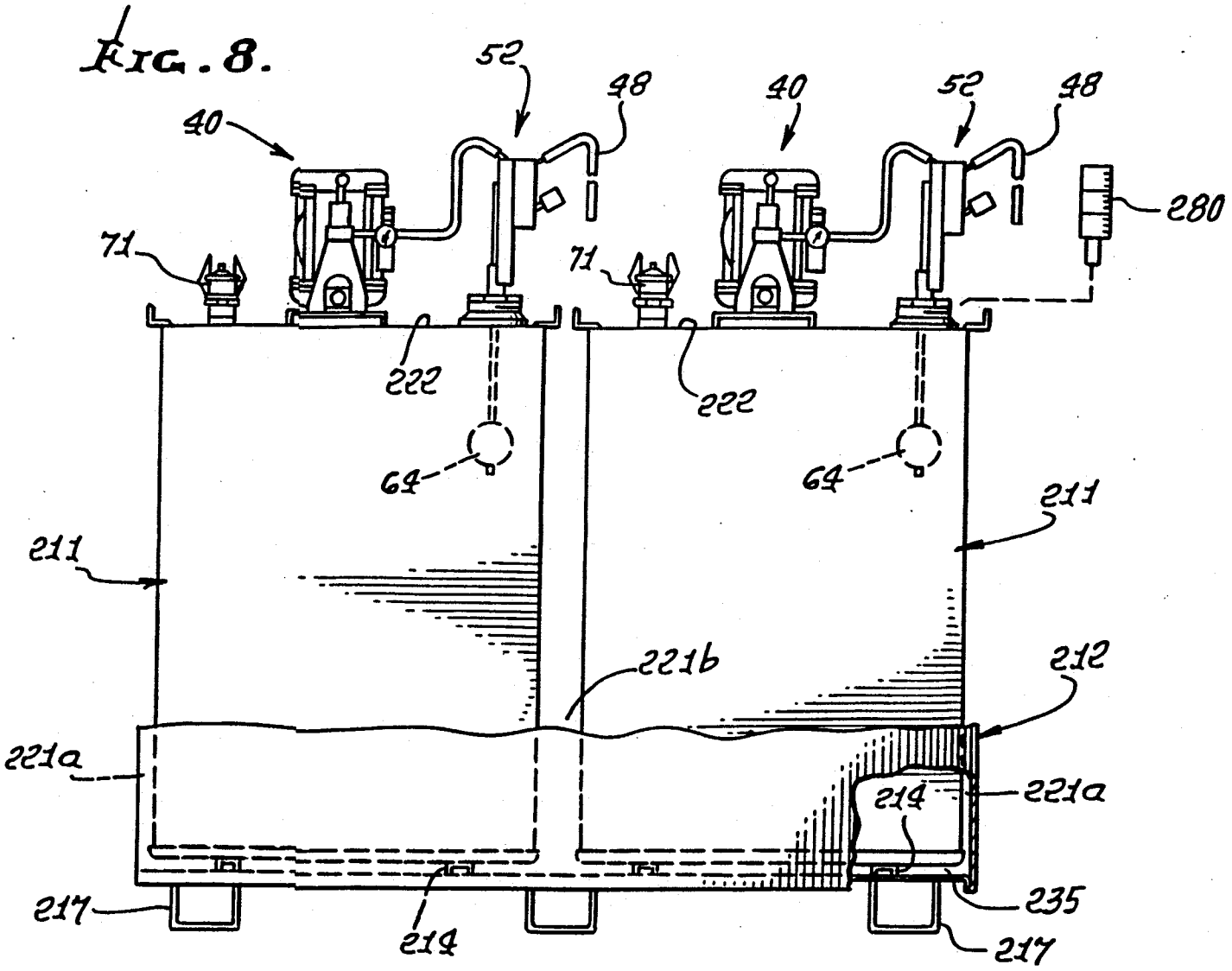
FIG. 8 is a front elevation showing interior construction of the FIG. 6 unit.
Figure 9:
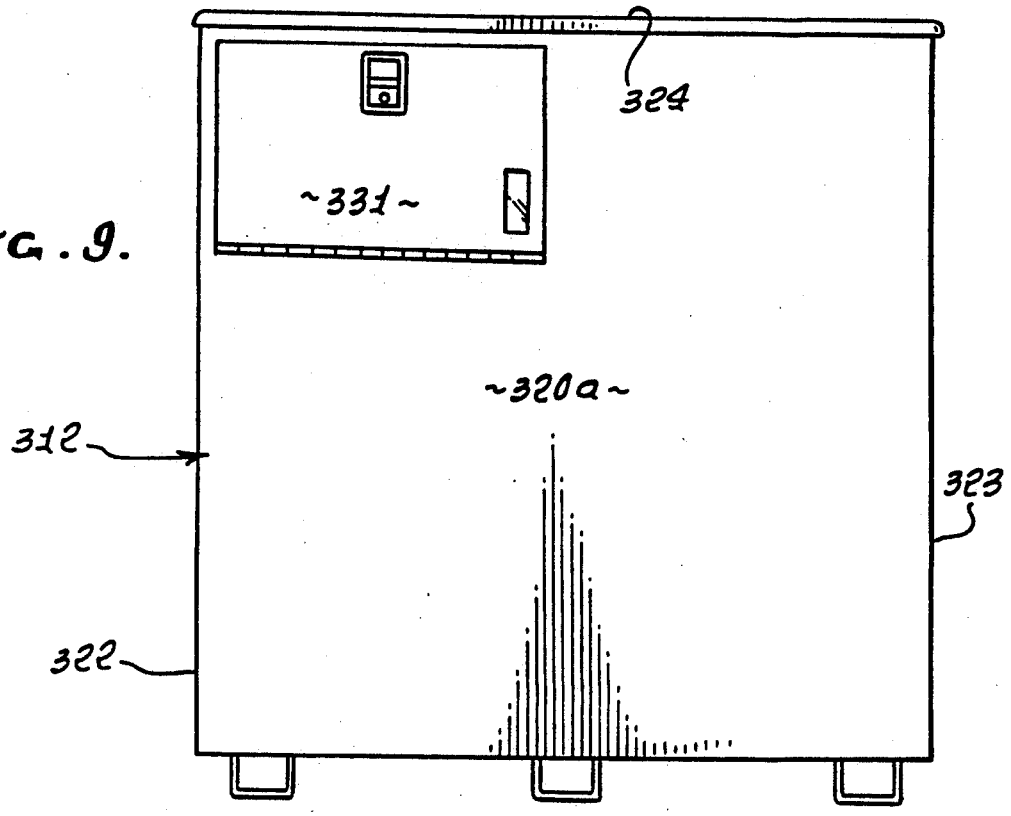
FIG. 9 is a front elevation of another modified multi-tank unit.
Figure 10:
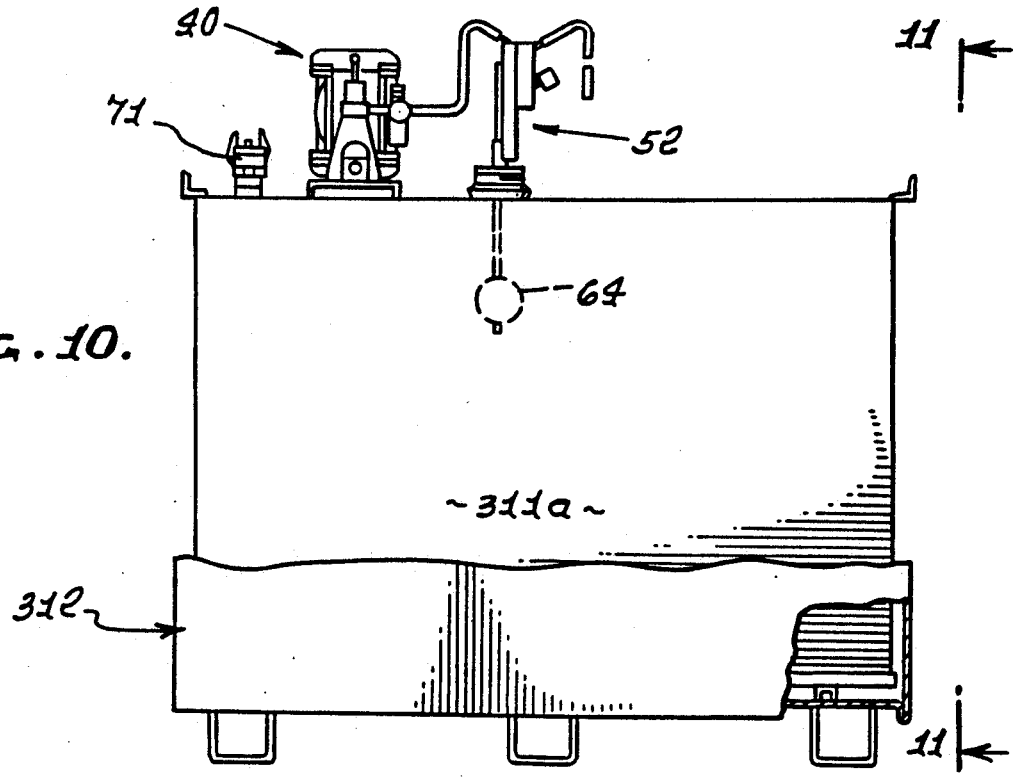
FIG. 10 is a front elevation showing interior construction of the FIG. 9 unit.
Figure 12:
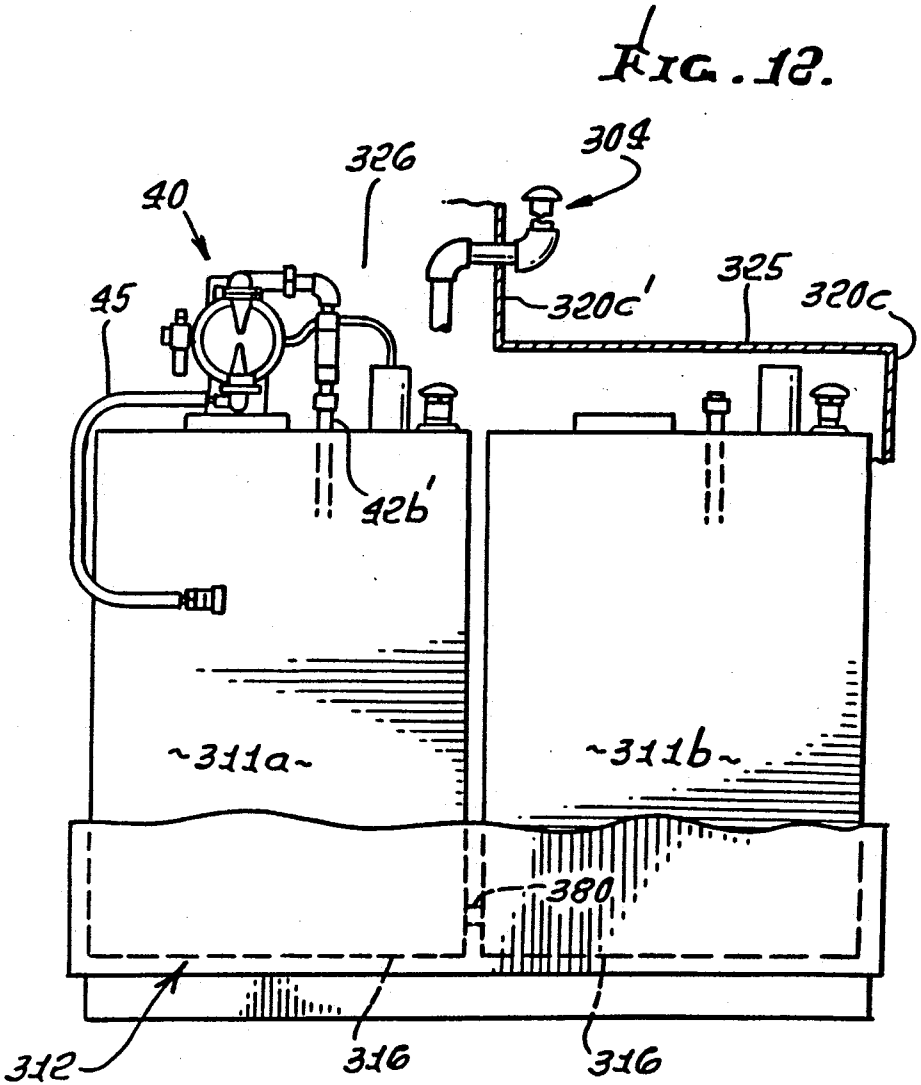
FIG. 12 is a side elevation showing interior construction of the FIGS. 9-11 unit.
Figure 11:
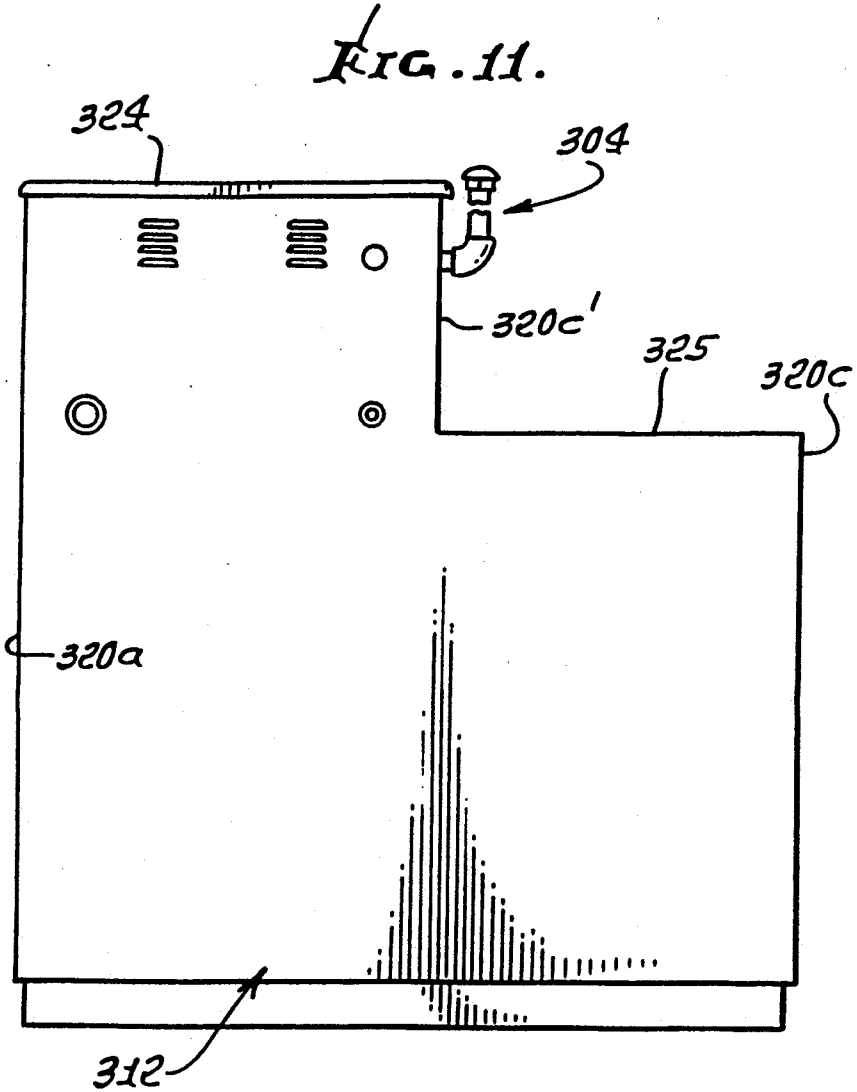
FIG. 11 is an end elevation taken on lines 11—11 of FIG. 10.
Figure 14:
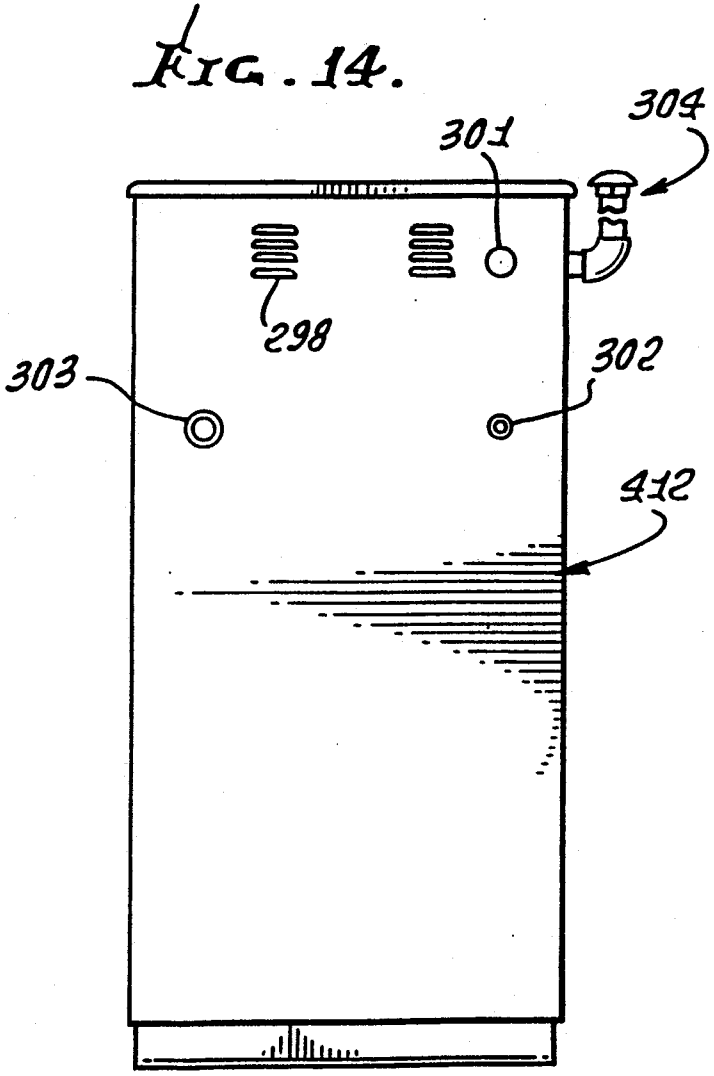
FIG. 14 is an end elevation taken on lines 14—14 of FIG. 13.
Figure 13:
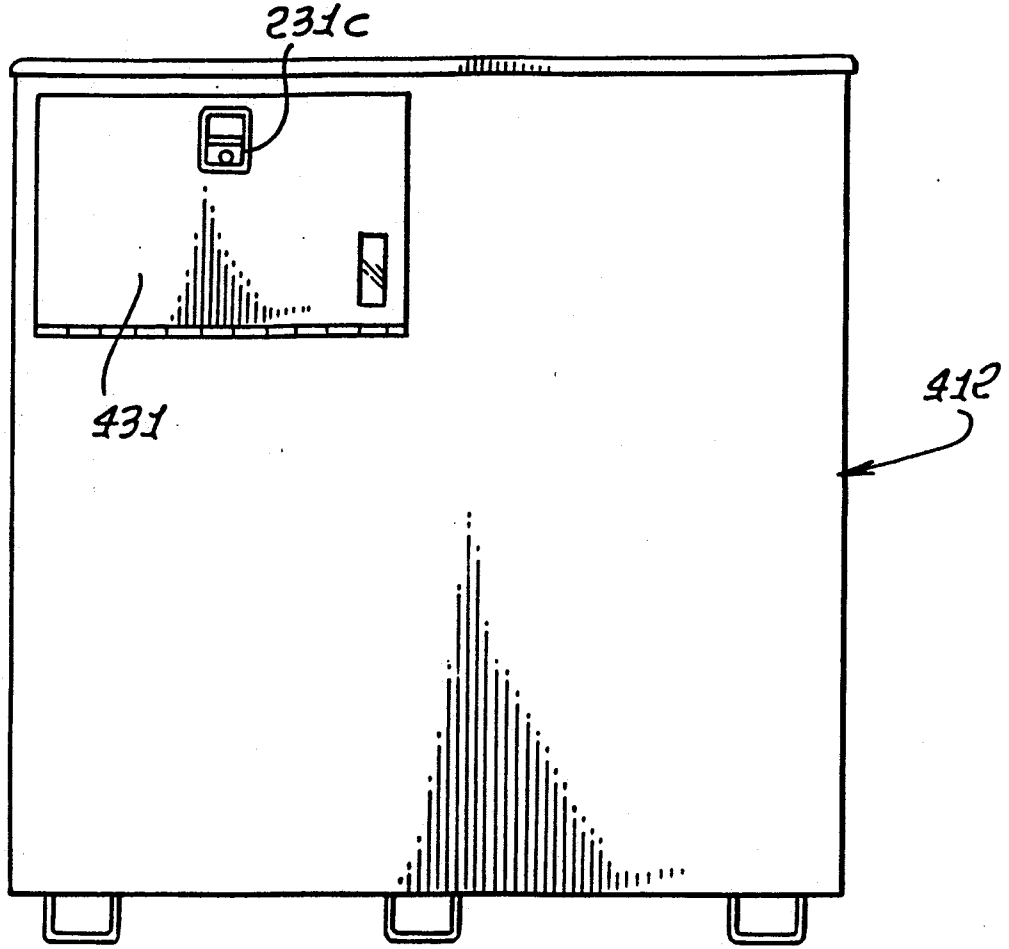
FIG. 13 is a front elevation of yet another modified tank construction.
Figure 16:
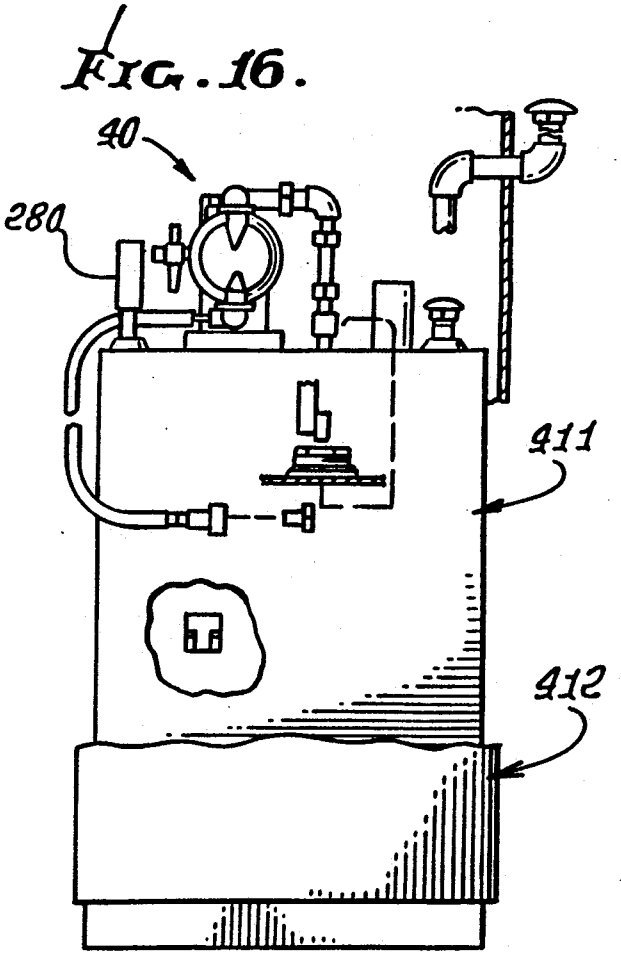
FIG. 16 is an end elevation on lines 16—16 of FIG. 15.
Figure 15:
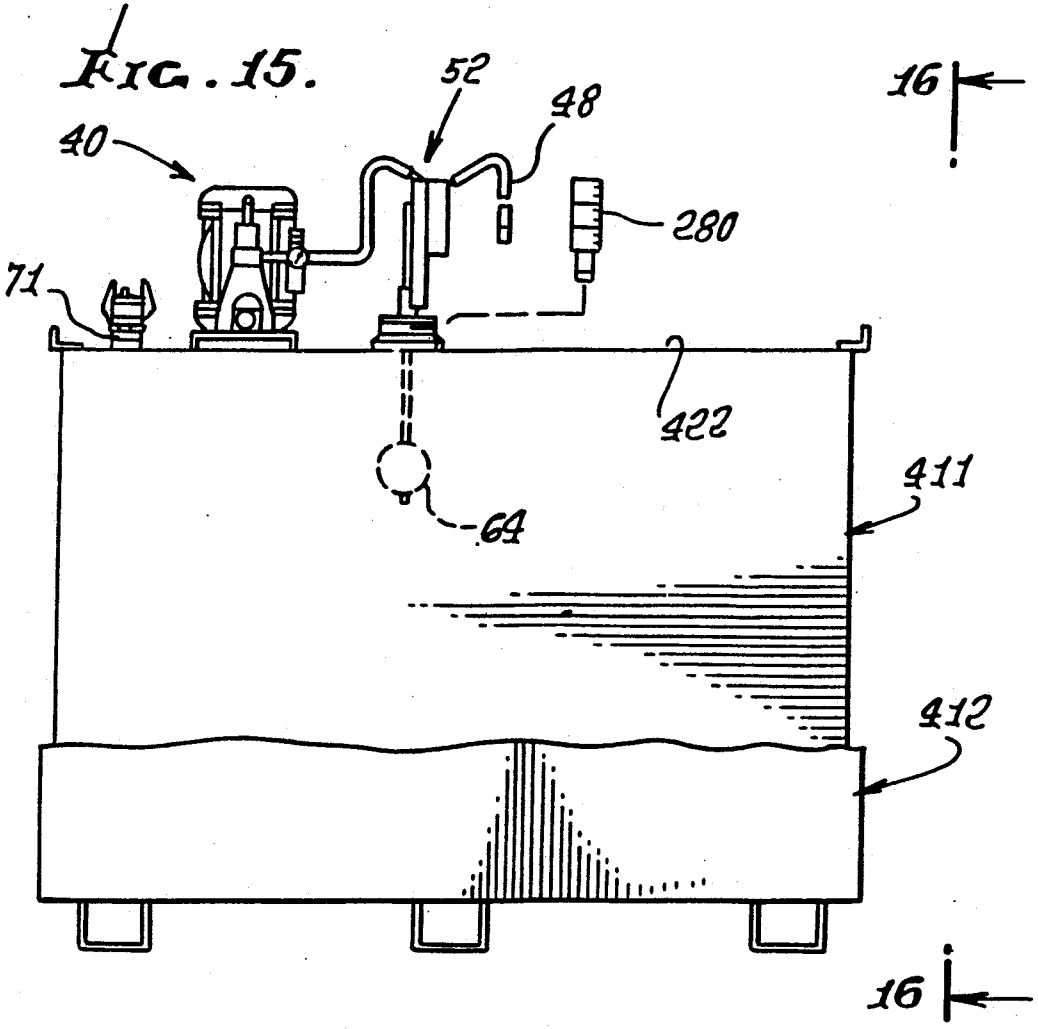
FIG. 15 is a front elevation of the FIG. 13 unit, broken away to show interior construction.

FIGS. 6–8 show a multiple tank assembly in a single unit. The outer tank 212 (corresponding to tank 12) is elongated to receive two like inner tanks 211, each of which corresponds to tank 11. Equipment is mounted on the top wall of each inner tank, and corresponds to the equipment discussed in FIGS. 1–5. The same identifying numerals are used to identify the item of such equipment.

The outer tank front wall panel 220*a* is of a length to accommodate the two inner tanks between outer tank end wall panels 220*b*, and also between front and back panels 220*a* and 220*c*. Two closures 231 (like closure 31) are hinge attached at 232 to the front wall to be movable, i.e., openable to expose the equipment mounted on the inner tank top walls 222. Note also the locks 231*c* for the closures, and the ports 269 in the closures via which oil level indicators 280 are visible. Note the spillage and leakage receiving spaces 221*a* between the inner tank upright walls, and the outer tank upright walls; the spillage space 221*b* between the two inner tanks, and the bottom space 235, corresponding to space 35. See also feet or spaces 214 and 217.

Associated with an outer tank end wall panel 220*b* are: louver vents 298, working vent (knock out) 301, air pressure line inlet (knock out) 302; and suction line inlet (knock out) 303. A working vent pipe elbow, with cap, is indicated at 304. Both inner tanks may be used to receive waste oil, as at vehicle filing stations, truck stops, and the like.

FIGS. 9–12 are like FIGS. 6–8 in that the outer tank 312 encloses or receives two like inner tanks 311*a* and 311*b*. The latter are spaced apart front-to-rear, relative to the front side or wall panel 320*a* of the outer tank. Accordingly, the two inner tanks have left-to-right length (see FIG. 10) about the same as, but slightly less than, the left-to-right length of the outer tank. The two inner tanks are in intercommunication, as via a duct or pipe 380 seen in FIG. 12, as located near the bottoms 316 of the two inner tanks. Accordingly, only one set of operating equipment is used, at the top of the inner front tank 311*a*. This is accessible via end closure 331, like one of the closures 231 referred to above. Two outer tank rear wall panels 320*c* and 320*c'* are provided, panel 320*c* located rearwardly of rear inner tank 311*b*, and panel 320*c'* located above the level of panel 320*a*, and forwardly thereof as an offset (in FIG. 11) to close the equipment space 326. See also outer tank side panels 322 and 323, and top walls 324 and 325.

FIGS. 13–18 again show a sidewardly elongated outer tank 412, having a single closure 431 via which access is gained to a single equipment set, as in FIGS. 1–5. The latter equipment is mounted on top wall 422 of a single inner tank 411, which is also elongated, left to right, as is clear from FIGS. 15 and 17.

Figure 17:
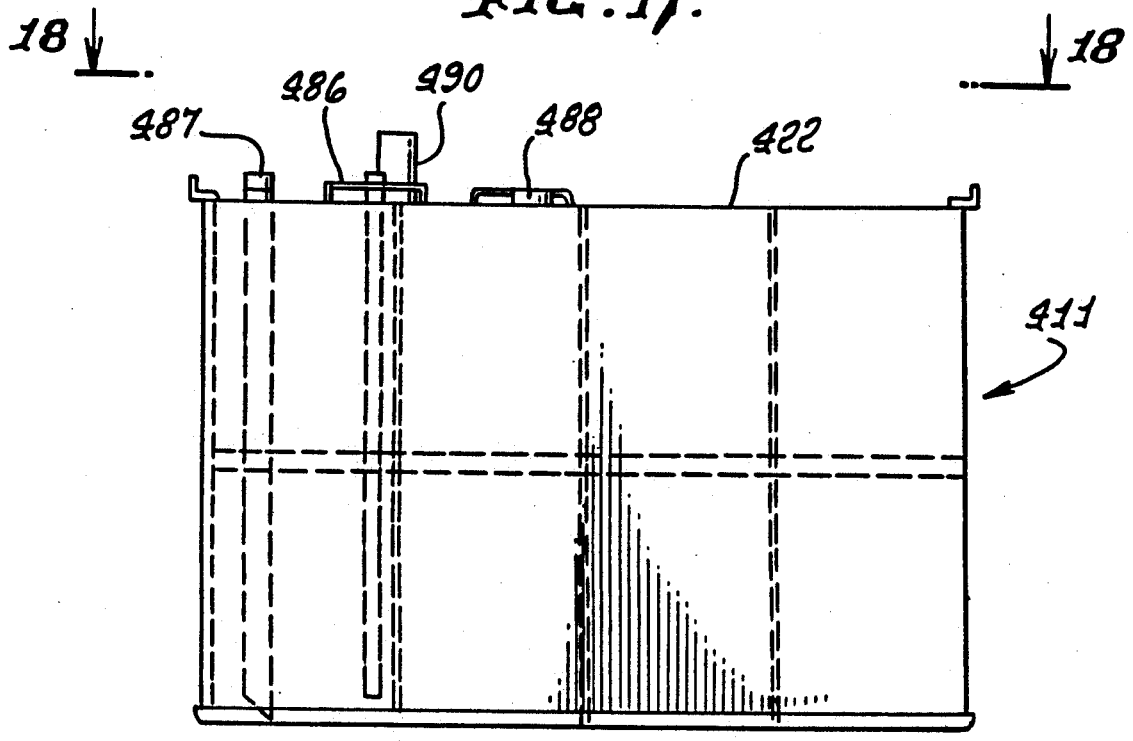
FIG. 17 is a front elevation, broken away, to show interior construction of the inner tank of the FIG. 13 unit.

FIG. 17 shows interior construction of the inner tank. Thus a single, enlarged, inner tank is provided.

Figure 18:
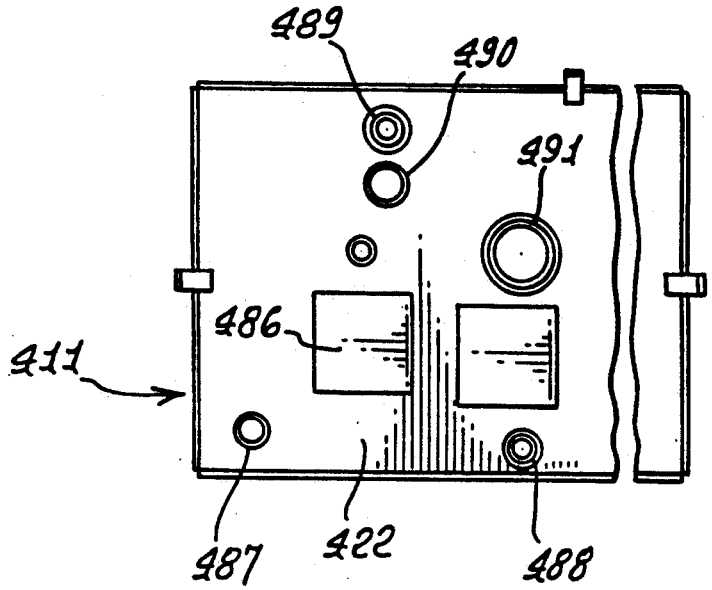
FIG. 18 is a top plan view taken on lines 18—18 of FIG. 17.

FIG. 18 shows the position of:

pump base 486 on wall 422.

suction line port 487 on wall 422
sight level port 488 on wall 422
working vent port 489, in 422
emergency evacuation vent port 490 in 422
shut-off valve mounting flange 491 on 422.

FIGS. 19–21 show tank structure 500 including a horizontally elongated, inner, metallic tank 511, which has a cylindrical cross section. It has a cylindrical outer wall 511*c*, and end walls 511*a* and 511*b*. A rectangular cross section, metallic, outer tank 512 protectively receives the inner tank, with interior spacing therebetween. See side spacing 515 and 516, top and bottom spacing 517 and 518, and rear spacing at 519. The tanks may be made of steel, with relatively thin walls ($\frac{1}{4}$–$\frac{3}{4}$ inches thick, for example). Outer tank 512 includes top wall 512*a*, bottom wall 512*b*, side walls 512*c* and 512*d*, and end walls 512*e* and 512*f*.

The tank structure 500 includes a vertical barrier wall 522 spaced at 520 from inner tank end wall 511*b*. The barrier wall extends upwardly from outer tank bottom wall 512*b*, and between side walls 512*c* and 512*d*, and is joined thereto as by welding. The top 522*a* of the barrier wall is spaced from the outer tank top wall 512*a*, to leave a gap 580 therebetween. Work space 526 is formed between barrier wall 522 and end wall 512*f*. A horizontal floor or platform 579*a* may be mounted or supported in space 526, and a suitable support at 578. Tank 511 is also supported on supports 571. Outer tank 512 is supported on pad 570 via supports 569, so that it can be easily moved about, lifted, transported, etc.

A closure 531 (lockable at 531*c*) is hinge attached at 531*a* to the outer tank wall 512*f* (which may also be considered as a "front" wall) to be movable, i.e., openable, for example, on hinge or hinges 531*a*, to expose the space 526 inwardly of the closure or cover 531, thereby providing direct access to controls indicated generally at 523. Such controls are protected by the leftward extension of the outer tank surrounding space 526.

The controls may also be considered to extend in the space 517 above the inner tank, as shown, so that any liquid spillage will drain downwardly into lower space 518, from which it may be removed, as by a suction line.

The controls correspond to those described above, and may include a pump and pump motor unit 540 (see 40 above), the pump having an intake port at 547 and a discharge port at 541. A liquid supply line 544 (corresponding to 44) extends via space 526 to the pump unit 540, as from the exterior after closure of 531 is opened; and line 544*a* extends via spaces 526 and 517 to the pipe 542*b* extending downwardly in tank 511. Unit 552, extending into space 517, senses the level of liquid in the inner tank, as via float 564 in tank 511 and pivoted at 564*a*. The unit 552 then controls the pump unit to control the flow of liquid into the interior of the inner tank 511, from the exterior of the safety apparatus. See control line or lead (in the case of electrical control) 569. A liquid removal line or pipe extends from within the tank 511 at 570*a*, and line 570*b* in spaces 517 and 526, to a connection 571 at the inner side of closure 531. See also connection 544*a*, to line 544, at the inner side of the closure. Access to such protected connections is gained upon opening of the locked closure 531. Pump 540 may be compressed air activated, as in FIG. 2, and controlled via unit 552, which then corresponds to valve 52.

Access to the controls and to the connections and spaces 526 and 517 may be gained at any time by opening the closure 531, at the end of the outer tank. The closure may be located in the side wall of the outer tank, facing space 526, if desired. More than one such inner tank 511 may be located within the outer tank 512, as seen in FIG. 25.

FIG. 22 shows the same combination of elements, as in FIGS. 19–21, except that the outer tank 512*a* is modified to have a circular cross section, viewed endwise.

In FIG. 23, the outer tank 512*a* is of circular cross section, but the inner tank 511*e* is now of rectangular cross section, viewed endwise.

In FIG. 24, both outer tank 512 and inner tank 511*e* are of rectangular cross section, viewed endwise.

Referring again to FIG. 19, the inside of the closure 531 is shown as coated with lightweight, fire-resistant material, such as foamed concrete or FENDOLITE, at 598. The inner side of the outer tank walls may be similarly coated, as at 599 in FIG. 20.

The thickness of the coating may be between $\frac{1}{4}$ inch and $\frac{3}{4}$ inch, for example.

FENDOLITE is a mixture of VERMICULITE and Portland Cement.

In FIG. 26, tank structure 600 includes a horizontally elongated, inner, metallic tank 611 having a cylindrical cross section. It has a cylindrical side wall 611*c*, and end walls 611*a* and 611*b*. A cylindrical or rectangular cross section outer metallic tank 612 protectively receives the inner tank, with interior spacing therebetween at the sides, top, bottom, and opposite ends, as in the manner of FIGS. 19–22. See for example top spacing 617, bottom spacing 618, and end spacing 619 and 620. The two tanks may be made of steel, with relatively thin walls, $\frac{1}{4}$ to $\frac{3}{4}$ inches thick.

Fireproof barrier wall 622 extends vertically and is spaced at 620 from inner tank 611. Wall 622 may extend entirely across the outer tank interior, to seal off the inner tank 611 from the work space 626 endwise of the inner tank. Barrier 622 may, for example, consist of FENDOLITE, or lightweight concrete, for example. A horizontal steel work floor or platform 679 is provided proximate the bottom of space 626; and a sump space 626*a* is located below that floor, which may contain vertical drain openings 679*b*. The inner tank is supported on the bottom wall of the outer tank, as via supports 671; and the outer tank is supported, via bottom supports 669, on a pad 670, so that it can be easily moved about, lifted, etc.

A closure 631 (lockable at 631*c*) is hinge supported or attached at 631*a* to the outer tank front wall 612*f*. The closure may be swung to open position, as shown, to expose interior work space 626 inwardly of the closure or cover 631, thereby providing direct access to controls 623, including a control panel indicated at 623*a*. The controls are protected from the fluid-receiving tank 611, as by the barrier wall 622. Spillage from the work space area 626 drains to sump 626*a*, for exit flow via sump space 618 beneath 616, and via drain valve 618*a*.

The controls may correspond to those above, or be as shown. Motor driven pump unit 640 has intake port at 646 and discharge port at 647. Liquid is delivered via supply line 644 having an intake connection at 644*a* accessed by opening the door 631. Liquid is pumped via intake valve 690, pump 640, exit valve 691, and lines 644 and 642 to the inner tank. A control unit 552 and 564 operates, as described above (see FIG. 19) and controls the level of liquid in the inner tank, via connections to the control panel 623*a*, which in turn controls the pump. Liquid is delivered from tank 611 via lines 670*a* and 670*b* leading to the pump 640 via valve 690. Liquid is delivered via the pump via valve 691 to exit pipe 671 and exit connection 671*a* accessible when door 631 is open. Valves 690 and 691 are each two position valves, with handles accessible when door 631 is open. In another configuration of the valves, liquid drawn from tank 611 is recirculated to that tank via the lines between the valves and the tank 611. Lines 670*b* and 642 have lower extents 670*b*' and 642' beneath floor 679, as shown.

Typical liquids includes hydrocarbons, as for example ethylene glycol. An alarm system may be provided to warn when the inner tank is about 90% full, and to shut off the pump in its "fill" mode, when the tank is about 95% full.

The controls in space 626 may alternatively be located in a compartment 696 above the outer tank, and concealed by a cover 697 supported on the outer tank. Cover 697 may have a lockable door 698 that is operable to give access to the controls (pump and valves and control panel). Connections 671*a* and 644*a* may thereby be isolated from the controls, for further safety.

I claim:

1. In safety tank apparatus for installation to receive and store a liquid hydrocarbon or hydrocarbons, or the like, and from which the liquid may be withdrawn, the combination comprising:

a) tank structure including an inner metallic tank, and an outer metallic tank protectively receiving the inner tank, the tank structure having a side wall, there being interior space laterally of the inner tank and within the tank structure, b) the tank structure including a barrier wall means extending between said inner tank and said interior space, c) an opening in said sidewall, and a locking closure closing said opening, the closure movable to expose said interior space to access from the exterior, d) and control means in said interior space, and accessible through said opening for controlling flow of said liquid into the inner tank from the exterior of said safety apparatus.

2. The combination of claim 1 wherein said tank structure includes a bottom wall extending laterally of the inner tank, said control means located above said bottom wall.

3. The combination of claim 2 wherein the inner and outer tanks define space therebetween, to receive drainage of liquid inadvertently spilled during operation of said control means.

4. The combination of claim 1 wherein said closure has hinged interconnection to the tank structure side wall.

5. The combination of claim 1 wherein said control means includes a pump having an intake port and delivery port, the delivery port communicating with the interior of the inner tank, and a drive connected with the pump and located within said interior space.

6. The combination of claim 5 including a valve for passing pneumatic fluid to the pump, and valve control means for sensing the level of liquid in the inner tank, and for closing the valve in response to rising of said level to a predetermined level 7. The combination of claim 6 wherein said valve control means includes a float in said inner tank.

8. The combination of claim 6 including an audible alarm associated with said valve and operable in response to closing of the valve.

9. The combination of claim 1 wherein the side wall and closure have hinge interconnection.

10. The combination of claim 1 including waste oil in the inner tank defined by a), and waste anti-freeze in the inner tank defined by a)'.

11. The combination of claim 1 including unused vehicle oil in said inner tank defined by a).

12. The combination of claim 1 including anti-freeze in said inner tank defined by a).

13. The combination of claim 1 including a view port in said locking closure to enable viewing of an indicator that indicates liquid level in the inner tank, and including said indicator in said interior space.

14. The combination of claim 1 including a second inner tank within said outer tank, said control means controlling flow of liquid into the second tank.

15. The combination of claim 1 including fire resistant material coating the inner side of the outer tank wall.

16. The combination of claim 1 including fire resistant material coating the inner side of the closure.

17. In safety tank apparatus for installation to receive and store a liquid hydrocarbon or hydrocarbons, or the like, and from which the liquid may be withdrawn, the combination comprising:

a) tank structure including an inner metallic tank, and an outer metallic tank protectively receiving the inner tank, the tank structure having a side wall, there being interior space laterally of the inner tank and within the tank structure, b) the tank structure including a barrier wall means extending between said inner tank and said interior space, c) an opening in said sidewall, and a locking closure closing said opening, the closure movable to expose said interior space to access from the exterior, d) and control means in said interior space, and accessible through said opening for controlling flow of said liquid into the inner tank from the exterior of said safety apparatus, e) said tank structure including a bottom wall extending laterally of the inner tank, said control means located above said bottom wall, f) and wherein said control means is supported on said bottom wall, in said interior space.

18. The combination of claim 17 wherein said inner tank has a side wall or walls, the interior of the inner tank maintained out of open communication with space defined between the inner and outer tanks.

19. In safety tank apparatus for installation to receive and store a liquid hydrocarbon or hydrocarbons, or the like, and from which the liquid may be withdrawn, the combination comprising:

a) tank structure including an inner metallic tank, and an outer metallic tank protectively receiving the inner tank, the tank structure having a side wall, there being interior space laterally of the inner tank and within the tank structure, b) the tank structure including a barrier wall means extending between said inner tank and said interior space, c) an opening in said sidewall, and a locking closure closing said opening, the closure movable to expose said interior space to access from the exterior, d) and control means in said interior space, and accessible through said opening for controlling flow of said liquid into the inner tank from the exterior of said safety apparatus, e) said control means including a pump having an intake port and delivery port, the delivery port communicating with the interior of the inner tank, and a drive connected with the pump and located within said interior space, f) a valve for passing pneumatic fluid to the pump, and valve control means for sensing the level of liquid in the inner tank, and for closing the valve in response to rising of said level to a predetermined level, g) and wherein said tank structure has a bottom wall that supports said pump and valve to be directly accessible via said opening in said tank structure side wall.

20. The combination of claim 19 wherein said inner tank has a top wall forming a first aperture via which liquid in the inner tank may be removed, via a duct extending below said top wall.

21. The combination of claim 20 wherein said inner tank top wall has a second aperture for venting air from the inner tank as liquid is filled into the inner tank by operation of the pump.

22. In safety tank apparatus for installation to receive and store a liquid hydrocarbon or hydrocarbons, or the like, and from which the liquid may be withdrawn, the combination comprising:

a) tank structure including an inner metallic tank, and an outer metallic tank protectively receiving the inner tank, the tank structure having a side wall, there being interior space laterally of the inner tank and within the tank structure, b) the tank structure including a barrier wall means extending between said inner tank and said interior space, c) an opening in said sidewall, and a locking closure closing said opening, the closure movable to expose said interior space to access from the exterior, d) and control means in said interior space, and accessible through said opening for controlling flow of said liquid into the inner tank from the exterior of said safety apparatus, e) and including support means associated with said tank structure and extending therebelow, the inner tank being horizontally elongated and said interior space located at one end of the elongated interior space.

23. In safety tank apparatus for installation to receive and store a liquid hydrocarbon or hydrocarbons, or the like, and from which the liquid may be withdrawn, the combination comprising:

a) tank structure including an inner metallic tank, and an outer metallic tank protectively receiving the inner tank, the tank structure having a side wall, there being interior space laterally of the inner tank and within the tank structure, b) the tank structure including a barrier extending between said inner tank and said interior space, c) an opening in said sidewall, and a locking closure closing said opening, the closure movable to expose said interior space to access from the exterior, d) control means in said interior space, and accessible through said opening for automatically effecting flow of said liquid into the inner tank from the exterior of said safety apparatus if the level of liquid in the inner tank is below one predetermined level and for preventing flow of said liquid into the inner tank if the level of liquid in the inner tank is at or above another predetermined level.

24. The combination of claim 23 including a valve via which pressurized fluid flows to said pump that pumps liquid into the inner tank, and float means sensing the level of liquid in the inner tank for operating said valve.

25. In safety tank apparatus for installation to receive and store a liquid hydrocarbon or hydrocarbons, or the like, and from which the liquid may be withdrawn, the combination comprising:

a) tank structure including a horizontally elongated inner metallic tank, and an outer metallic tank protectively receiving the inner tank, the inner tank adapted to receive in-flow of said liquid, b) the inner and outer tanks defining a vertically extending space therebetween, to receive drainage of leaked or spilled liquid, c) and control mans within the tank structure for automatically preventing in-flow of liquid into the inner tank if the level of liquid received into said inner tank is above a predetermined level, d) said control means including a pump within interior space defined by the tank structure and located laterally of one end of the inner tank, e) there being a barrier wall means between the pump and said inner tank, the tank structure defining an access opening to said pump.

26. In safety tank apparatus for installation to receive and store a liquid hydrocarbon or hydrocarbons, or the like, and from which the liquid may be withdrawn, the combination comprising:

a) tank structure including a horizontally elongated inner metallic tank, and an outer metallic tank protectively receiving the inner tank, the inner tank adapted to receive in-flow of said liquid, b) the inner and outer tanks defining a vertically extending space therebetween, to receive drainage of leaked or spilled liquid, c) and control mans within the tank structure for automatically preventing in-flow of liquid into the inner tank if the level of liquid received into said inner tank is above a predetermined level, d) said control means including a pump within interior space defined by the tank structure and located laterally of one end of the inner tank, e) and wherein said control means includes a float in the inner tank and movable to prevent said in-flow of liquid into the inner tank if the level of liquid in the inner tank is above an upper predetermined level, and for permitting in-flow of liquid into the inner tank if the level of liquid in the inner tank is at or below a lower predetermined level.

27. The combination of claim 26 wherein said outer tank is also horizontally elongated, and including support means supporting said outer tank on a support surface.

28. In safety tank apparatus for installation to receive and store a liquid hydrocarbon or hydrocarbons, or the like, and from which the liquid may be withdrawn, the combination comprising:

a) tank structure including a horizontally elongated inner metallic tank, and an outer metallic tank protectively receiving the inner tank, the inner tank adapted to receive in-flow of said liquid, b) the inner and outer tanks defining a vertically extending space therebetween, to receive drainage of leaked or spilled liquid, c) and control mans within the tank structure for automatically preventing in-flow of liquid into the inner tank if the level of liquid received into said inner tank is above a predetermined level, d) said control means including a pump within interior space defined by the tank structure and located laterally of one end of the inner tank, and including a valve via which pressurized fluid flows to said pump that pumps liquid into the inner tank, and float means sensing the level of liquid in said inner tank for operating said valve.

29. In safety tank apparatus for installation to receive and store flammable liquid, or the like, and from which liquid may be withdrawn, the combination comprising tank structure for installation to receive and store a liquid hydrocarbon or hydrocarbons, or the like, and from which the liquid may be withdrawn, said structure including an inner metallic tank; an outer metallic tank protectively receiving the inner tank with accessible interior space laterally of the inner tank; a barrier wall between that interior space and the inner wall; an opening in the outer tank sidewall adjacent that interior space; and a closure closing the opening, the closure movable to expose the interior space to access from the exterior; and tank liquid flow control structure accessible through the side wall opening, for controlling filling of the liquid into the inner tank from the exterior of the safety apparatus, and for controlling liquid removal from the inner tank.

30. The combination of claim 29 wherein said barrier wall consists of fire resistant material.

31. The combination of claim 29 wherein said flow control structure includes pump means and valve means connected therewith, there being flow lines extending between the valves and the interior of the inner tank, said flow lines connected to said valve means and passing through said barrier, and there being flow connections in said interior space and connected to said valves, for delivery of liquid to the inner tank via the pump means, and for draining liquid from the inner tank, via the pump means.

32. The combination of claim 31 including a floor in said interior space below said pump means and valve means, said flow lines extending below said floor.

33. The combination of claim 31 wherein the pump means and valve means are in said interior space.

34. The combination of claim 31 wherein the pump means and valve means are outside said interior space and protected by wall structure on said outer tank.

* * * * *